United States Patent [19]

Germe

[11] 4,449,655

[45] May 22, 1984

[54] COMBINATION BACKPACK AND GEAR BAG

[75] Inventor: Patrick P. Germe, Irvine, Calif.

[73] Assignee: U.S.D. Corp., Santa Ana, Calif.

[21] Appl. No.: 308,145

[22] Filed: Oct. 5, 1981

[51] Int. Cl.[3] ..... A45F 3/00

[52] U.S. Cl. ..... 224/153; 224/210; 224/211; 150/52 R

[58] Field of Search ..... 224/153, 151, 201, 210, 224/211, 214, 215, 216, 261, 262; 150/265, 52 R

[56] References Cited

U.S. PATENT DOCUMENTS

| | | | |
|---|---|---|---|
| 2,475,135 | 7/1949 | Haven | 224/210 X |
| 2,836,334 | 5/1958 | Davis | 224/210 X |
| 3,316,951 | 5/1967 | Jacobson | 224/151 X |
| 3,957,183 | 5/1976 | Gadberry | 224/211 |

*Primary Examiner*—Steven M. Pollard

*Attorney, Agent, or Firm*—George F. Bethel; Patience K. Bethel

[57] ABSTRACT

The following specification discloses a combination backpack and gear bag for use by an underwater diver. The backpack is one wherein a container of gas such as a tank of pressurized gas is held on the back of a diver for purposes of providing a diver with breathing gas while diving. The backpack can be supported by straps across a user's body, or by means of a buoyancy compensator attached to the backpack for supporting the backpack and the tank therewith. The gear bag is such that it allows a backpack to be interconnected thereto. This is possible by means of insertion of the band or other connection means which holds the gas cylinder against the backpack through a passage in the gear bag followed by implacement of the gas cylinder within the gear bag and securing it with the connection means. The gear bag is oriented so that it can include within a portion thereof, carrying space for not only the cylinder, but other attendant apparatus, such as fins, snorkels, wetsuits, gloves, and other diving apparatus. When the backpack and the gear bag are not to be carried by the backpack, the entire gear bag can be carried by means of handles with the backpack or backpack-buoyancy compensator in a separate exterior compartment. The exterior compartment which receives the backpack or backpack-buoyancy compensator is created by a shroud or flap that overlies the backpack or backpack-buoyancy compensator. In this manner, the entire gear bag can be carried as one integral gear bag or carried as a combination backpack and gear bag with all of the diver's equipment therein.

4 Claims, 9 Drawing Figures

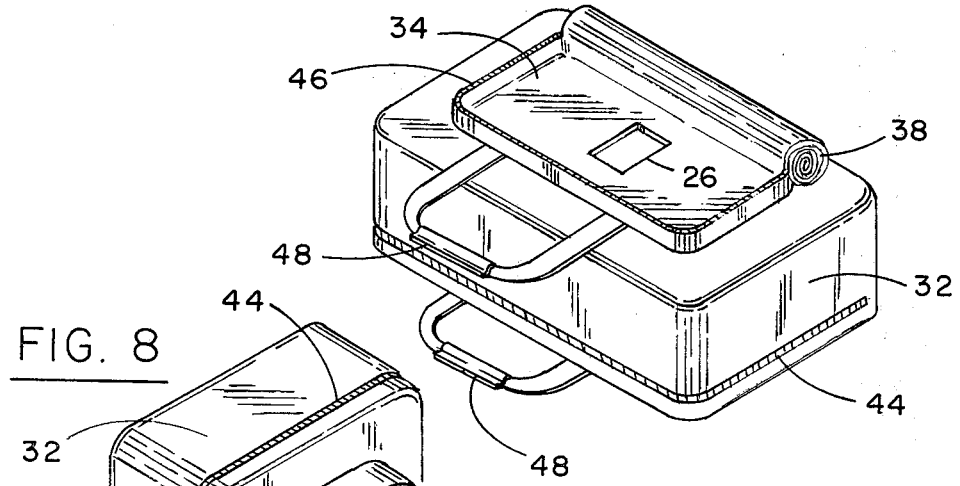
FIG. 6
FIG. 8
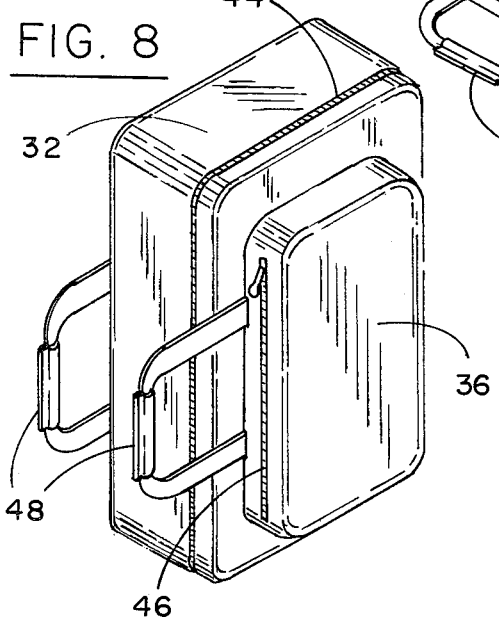
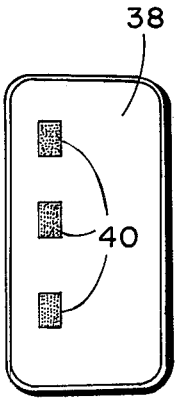
FIG. 7
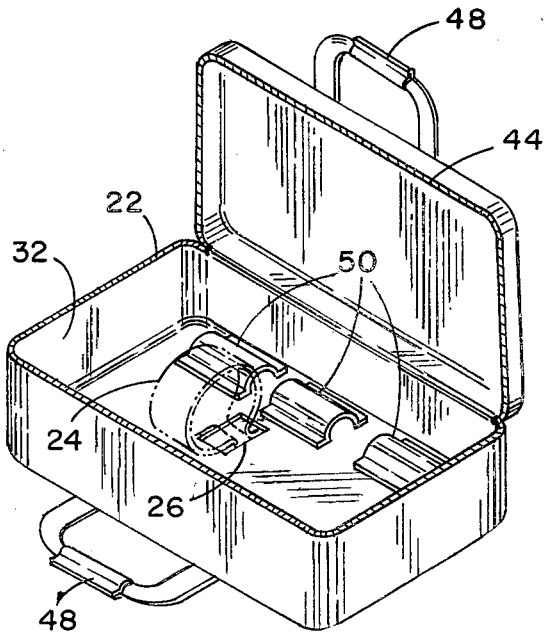
FIG. 9

COMBINATION BACKPACK AND GEAR BAG

BACKGROUND OF THE INVENTION

Diving requires the transport of an extensive array of diving equipment, including for example, a pressurized breathing gas or air tank, a backpack to carry the breathing gas tank during diving, a buoyancy compensator, a breathing tank pressure gauge, a pressure regulator, a snorkel, a wetsuit, fins, gloves, a knife, a flashlight, and the like. All of this diving equipment is normally carried in a gear bag which resembles a duffle bag made of a strong fabric with handles. Such a bag is convenient for transport of the diving equipment as well as for storage of the equipment when not in use. The major drawback of the above described gear bag is that due to the amount of diving equipment required, it is quite heavy and, thus, awkward to carry.

This invention is directed to an improved gear bag which will alleviate the drawbacks of the prior art gear bags by allowing the gear bag to be carried on the back. At the same time the versatility of the bag is preserved so that it can be carried by hand if desired.

SUMMARY OF THE INVENTION

A combination backpack and gear bag is provided according to the invention which is designed to accommodate all the above mentioned diving equipment and which can be carried by hand by means of handles on the gear bag or attached to a backpack.

The gear bag includes a passage within one of its major sides for receiving the connecting band or strap portion of a backpack or backpack-buoyancy compensator which is designed to hold the breathing gas tank. Thus, the backpack can be worn with one wall of the gear bag held between the backpack and the breathing gas tank which is contained within the gear bag during use.

The backpack which is used with the gear bag combination can be of any commercially available type, such as that consisting of a back plate which has a conformation suitable for receiving a tank of breathing gas and a band or strap for securing around the breathing gas cylinder. The backpack is attached to the user's body by means of a combination of shoulder and waist straps. Alternately, the backpack as above described can be replaced with a backpack buoyancy compensator combination, in which the buoyancy compensator replaces the harness straps which go over the shoulder.

The gear bag is connected to and supported by the backpack or backpack-buoyancy compensator by means of a passage through the gear bag which is designed to accommodate the breathing gas tank connection means which extends from the backpack or backpack-buoyancy compensator. This connection in the form of a band or strap is extended through the passage within the gear bag, followed by attachment of the breathing gas tank. The result is that a major wall of the gear bag is compressed and supported between the back plate of the backpack or backpack-buoyancy compensator and the surface of the breathing gas tank.

The gear bag is also provided with a pair of straps or handles so that the backpack or backpack-buoyancy compensator, as well as the other diving gear can be fully enclosed within the gear bag and carried in the normal manner.

When the backpack or backpack-buoyancy compensator is fully enclosed in an exterior compartment of the gear bag, it is covered by a flap or shroud. According to a special feature, the flap or shroud can be rolled up on itself, and secured in the rolled-up condition to keep it out of the way when the gear bag is being carried on the back in the aforementioned manner. Also, in addition to the major area or compartment where the gas cylinder is contained in the gear bag, there is provided a plurality of pockets for purposes of storing a breathing gas regulator, a pressure gauge, a depth meter, and the like. An additional exterior compartment on the side of the gear bag which is opposite that which carries the backpack, provides additional space for separate storage of additional diving equipment, including fins, a wetsuit, and so forth.

A particular advantage of the combination backpack-gear bag is that the backpack can be implaced within the gear bag and attached thereto, providing the option of carrying the backpack-gear bag combination by the handles or straps, or by simply rolling back the flap or an exterior compartment exposing the backpack or backpack-buoyancy compensator for carrying the entire gear bag on the user's back. Upon reaching the diving site, the backpack or backpack-buoyancy compensator can be disconnected from the gear bag by releasing the connecting strap or band which holds the breathing gas tank connected to the backpack. This is followed by slipping the connection means out through the passage within the gear bag and reconnecting the breathing gas tank to the backpack or backpack-buoyancy compensator for diving use.

The backpack-gear bag combination is constructed of an extremely lightweight, yet durable tough material, so that it can be assured of strength, lightweight, durability and long life.

The invention will be more readily understood by reference to the attached drawings, taken together with the description to follow.

DESCRIPTION OF THE DRAWINGS

FIG. 6 shows a perspective view of the combination gear bag and backpack lying on its side;

FIG. 7 shows a view taken in the direction of 7—7 of FIG. 4 of the velcro tabs adhered to the inside of one of the exterior compartments of the combination gear bag and backpack;

FIG. 8 shows a perspective view of the combination gear bag and backpack lying on one side; and FIG. 9 shows a perspective view of the combination gear bag and backpack in the open condition to show the interior thereof and to show the backpack cylinder connection band extending through a passage in the gear bag.

DESCRIPTION OF THE PREFERRED EMBODIMENTS

Figure 1:
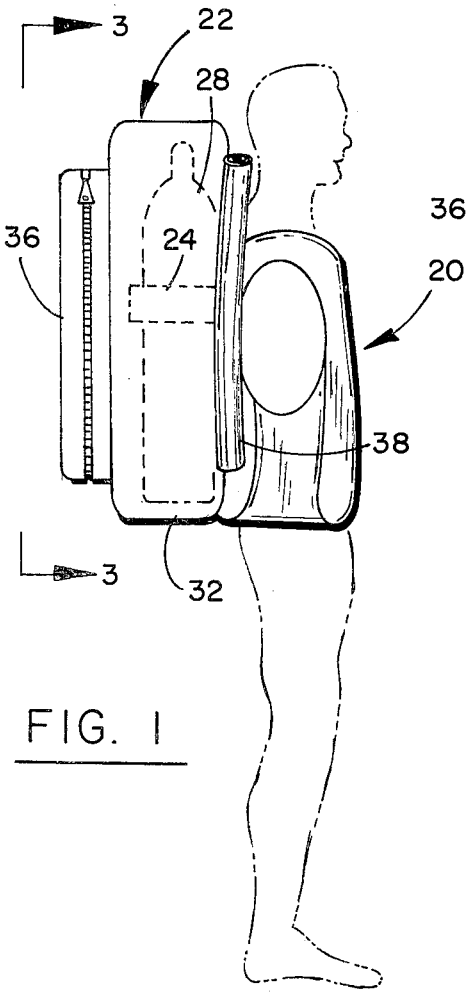
FIG. 1 shows a side view of the combination gear bag and backpack as it would be carried on a user's back.
Figure 2:
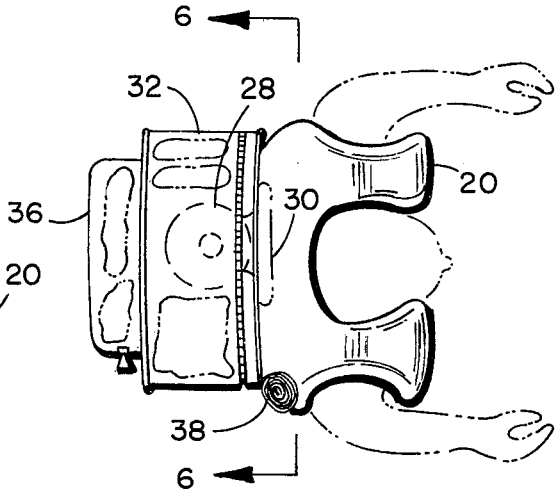
FIG. 2 shows a plan view of the combination gear bag and backpack of FIG. 1.
Figure 5:
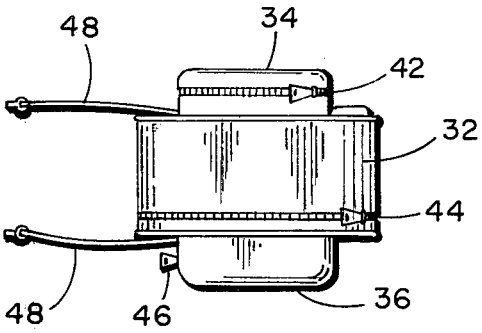
FIG. 5 shows a plan view of the combination gear bag and backpack taken from the direction 5—5 of FIG. 3.

Referring now to FIG. 1, it can be seen that the gear bag and backpack combination is being carried on a user's back. In the embodiment shown in FIG. 1, the user has a backpack-buoyancy compensator combination 20 which is connected to the gear bag 22 by means of a breathing gas tank connection band 24, which extends through a passage 26 in the gear bag as shown in FIG. 9. The gas cylinder 28 is attached to and held by the connecting band 24 while being fully contained in and enclosed by the gear bag 22. This condition secures the gear bag 22 between the gas cylinder 28 and the back plate 30 of the backpack-buoyancy compensator combination 20, as indicated in FIG. 2.

Figure 4:
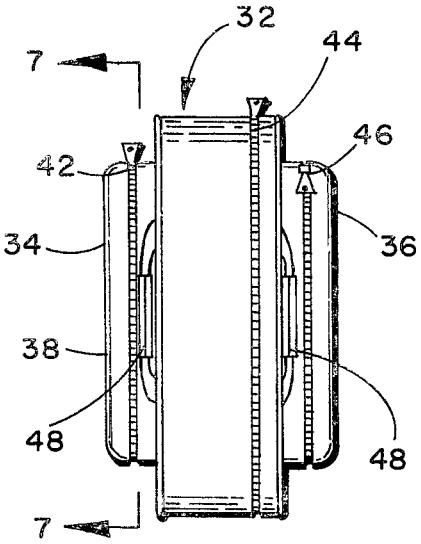
FIG. 4 shows a side view of the combination gear bag and backpack taken from the direction 4—4 of FIG. 3.
Figure 3:
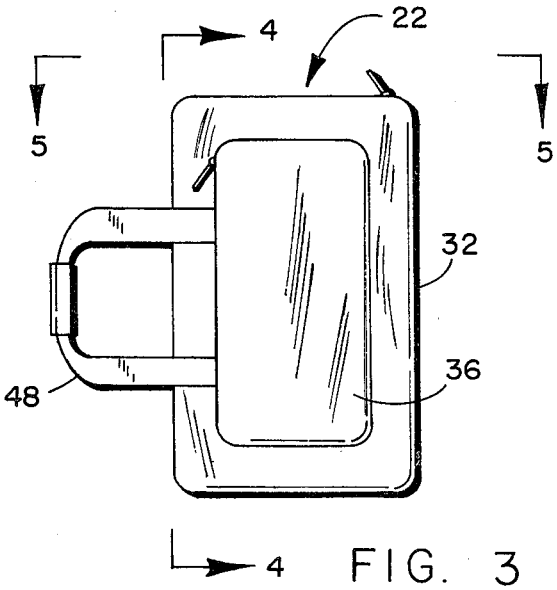
FIG. 3 shows a back view of the gear bag-backpack combination, taken from the direction 3—3 of FIG. 1.

The gear bag 22, as shown in FIG. 4, includes a large major compartment 32 which accommodates the breathing gas tank 28 and certain other diving gear and two exterior compartments 34 and 36. The exterior compartment 36 is designed to store various types of diving gear which will not fit in the larger compartment 32.

The exterior compartment 34 is designed to accommodate the backpack-buoyancy compensator combination 20 when it is fully enclosed in the gear bag 22. It is formed with an exterior shroud or flap 38 which is capable of being rolled upon itself and secured in the rolled condition, as shown in FIGS. 1 and 2. This permits a user to roll up the flap 38 and secure it out of the way when it is desired to carry the combination gear bag and backpack on a user's back. The detailed view of the flap 38 in its extended position is shown in FIG. 7. As shown, there are velcro fasteners 40 which allow the flap 38 to be secured in the rolled up position.

When it is desired to close the gear bag 22 and use it in the conventional manner, all of the compartments 34, 32 and 36, are closed with zippers 42, 44 and 46, respectively. When in the fully closed condition, the gear bag 22 can be carried in the conventional manner by means of straps or handles 48.

Within the major compartment 32 are a number of pockets 50 which are designed to accommodate breathing gas regulators, depth and pressure gauges. The provision of the inner pockets allows for the secure protection of these instruments from contact with the gas cylinder 28 which might result in the breakage thereof.

The combination gear bag-backpack is preferably constructed of a strong, durable material, which is resistant to attack by water, salt, and the like. Examples of such materials might include rip-stop nylon, plastic coated canvas such as vinyl coated canvas, and the like.

The invention as described above provides a combination backpack and gear bag whereby the gear bag can be carried on a user's back in lieu of being carried by its handles. This is effected by passage of the breathing gas tank connection securement band through a passage in the gear bag and then connecting the gas cylinder. This causes the gear bag material to be compressed between the surface of the gas cylinder and the back plate of the backpack. According to a preferred embodiment, in place of the backpack, there can be used a combination backpack-buoyancy compensator. In either case, the backpack or backpack-buoyancy compensator combination when not in use is contained in an exterior compartment of the gear bag. An additional exterior compartment adds to the storage capability of the gear bag. When the combination backpack-gear bag is being carried on a user's back, a flap on the exterior pocket can be rolled up and secured out of the way for convenience to the user. Upon arriving to the place where diving is to take place, the gas cylinder can be removed from its connection to the backpack, the backpack connection slipped out of the passage within the gear bag, and the gas cylinder then reconnected for diving.

While the drawings have shown a single breathing gas cylinder, it should be understood that the invention is also intended to cover multiple cylinder backpacks, and especially twin cylinder backpacks, which would operate in the same manner. Also, the band 24 can be made of a flexible metal band with an overcenter tightening means, a webbed strap, or a strap and buckle arrangement.

Other modifications of the present invention are contemplated and can be resorted to by those skilled in the art, without departing from the spirit and scope of the invention as defined by the following claims.

I claim:

1. A gear bag for receiving a backpack connected thereto comprising:

opening and closing means so that said bag can be opened and closed;

a major surface of said bag having a passage therethrough for receipt of a breathing gas tank connection means extending from a backpack so that said gear bag can receive a breathing gas tank therein and can be carried by being supported thereon when said breathing gas tank is held by a backpack carried by a user;

an external compartment in surrounding relationship to said passage therethrough having a major flap for providing said compartment with means wherein said compartment can receive the backpack therein when said gear bag is not being carried by the backpack; and, closure means for said compartment by means of attaching said flap in said overlying relationship to said backpack as it is received within said compartment.

2. The gear bag as claimed in claim 1 further comprising:

means for rolling said flap and securing it externally on said gear bag when said backpack is used to carry said gear bag.

3. A gear bag for receiving a backpack connected thereto comprising:

opening and closing means so that said bag can be opened and closed;

a major surface of said bag having a passage therethrough for receipt of a breathing gas tank connection means extending from a backpack so that said gear bag can receive a breathing gas tank therein and can be carried by being supported thereon when said breathing gas tank is held by a backpack carried by a user;

an external compartment in surrounding relationship to said passage therethrough having a major flap for providing said compartment with means wherein said compartment can receive the backpack therein when said gear bag is not being carried by the backpack;

closure means for said compartment by means of attaching said flap in said overlying relationship to said backpack as it is received within said compartment; and, a second compartment for receiving divers' equipment therein.

4. A gear bag for receiving a backpack connected thereto comprising:

opening and closing means so that said bag can be opened and closed;

a major surface of said bag having a passage therethrough for receipt of a breathing gas tank so that said gear bag can receive a breathing gas tank therein and can be carried by being supported thereon when said breathing gas tank is held by a backpack carried by a user;

an external compartment in surrounding relationship to said passage therethrough having a major flap for providing said compartment with means wherein said compartment can receive the backpack therein when said gear bag is not being carried by the backpack;

closure means for said compartment by means of attaching said flap in said overlying relationship to said backpack as it is received within said compartment; and, pockets internal within said gear bag for receiving diver's equipment therein.

* * * * *